US005694844A

United States Patent [19]

Taira

[11] Patent Number: 5,694,844

[45] Date of Patent: Dec. 9, 1997

[54] STENCIL STAMP ASSEMBLY

[75] Inventor: Hiroshi Taira, Ichinomiya, Japan

[73] Assignee: Brother Kogyo Kabushiki Kaisha, Nagoya, Japan

[21] Appl. No.: 802,940

[22] Filed: Feb. 21, 1997

Related U.S. Application Data

[63] Continuation of Ser. No. 396,720, Mar. 1, 1995, abandoned.

[30] Foreign Application Priority Data

Apr. 20, 1994 [JP] Japan ..... 6-081278

[51] Int. Cl.[6] ..... B41K 1/32

[52] U.S. Cl. ..... 101/125; 101/333

[58] Field of Search ..... 101/103, 109, 101/125, 128.1, 128.21, 128.4, 129, 327, 333

[56] References Cited

U.S. PATENT DOCUMENTS

| | | | |
|---|---|---|---|
| 1,975,488 | 10/1934 | Trull et al. | 101/125 |
| 2,667,119 | 1/1954 | Thomas | 101/125 |
| 3,570,396 | 3/1971 | Schwartzman | 101/125 |
| 3,626,844 | 12/1971 | Priesmeyer | 101/125 |
| 3,641,934 | 2/1972 | Rudolf | 101/333 |
| 3,952,663 | 4/1976 | McFarland | 101/327 |
| 4,306,498 | 12/1981 | Fujimura | 101/333 |
| 4,336,767 | 6/1982 | Wada | 101/333 |
| 4,441,422 | 4/1984 | Dreeben | 101/125 |
| 4,927,695 | 5/1990 | Ooms et al. | 101/333 |
| 4,986,175 | 1/1991 | Boehringer et al. | 101/125 |
| 5,253,581 | 10/1993 | Miki et al. | 101/125 |
| 5,285,725 | 2/1994 | Imamaki et al. | 101/128.21 |
| 5,483,880 | 1/1996 | Seo et al. | 101/125 |
| 5,582,105 | 12/1996 | Miki et al. | 101/125 |

FOREIGN PATENT DOCUMENTS

| | | | |
|---|---|---|---|
| 545599 | 6/1993 | European Pat. Off. . | |
| 156982 | 7/1987 | Japan | 101/125 |
| 336279 | 11/1992 | Japan | 101/125 |
| 5-74833 | 3/1993 | Japan . | |

*Primary Examiner*—Stephen R. Funk
*Attorney, Agent, or Firm*—Oliff & Berridge

[57] ABSTRACT

A stencil stamp assembly having a comparatively small size, high ink holding capacity, excellent stamping durability and is capable of stamping images having a high print quality. The stencil stamp includes a handgrip and a stencil stamp assembly. The stencil stamp assembly includes an ink bearing member covered with a thermal stencil sheet. The thermal stencil sheet has a plurality of pores on holes arranged in a pattern. During a stamping action, ink from the ink bearing member is forced through the pores in the stencil sheet and onto a recording sheet to form a stamped image on the recording sheet. The ink bearing member has at least two layers having different densities. The less dense layer is in contact with the thermal stencil sheet. The least dense layer provides a large ink storage capacity. The more dense layer has a higher ink holding capacity, which reduces the potential for ink leakage. The more dense layer is also more firm, which reduces creasing and distortion of the stencil sheet both during stamping and during formation of the pore pattern in the stencil sheet.

24 Claims, 12 Drawing Sheets

STENCIL STAMP ASSEMBLY

This is a Continuation of application Ser. No. 08/396,720 field Mar. 1, 1996 now abandoned.

BACKGROUND OF THE INVENTION

U.S. patent application Ser. No. 08/337,215 filed Nov. 7, 1994, now U.S. Pat. No. 5,582,105 issued Dec. 10, 1996 contains technical matter related to this application.

1. Field of the Invention

The present invention relates to a stencil stamp assembly for use on a stamping device, and more particularly, to a stencil assembly having an ink-bearing member impregnated with ink, and a thermal stencil forming a stamping part.

2. Description of Related Art

Stamps provided with a rubber stamping member have been used for stamping the surface of a recording sheet with company names, addresses and the like in character strings. Generally, stamps for such uses are made individually, to order. As a result, the stamps are relatively expensive, and it requires a relatively long time to procure a stamp after placing an order.

A thermal stencil sheet has been practically used on such stamps instead of a rubber stamping member. Pores can be formed in a desired pattern in a thermal stencil sheet with infrared beams or a thermal head. Character strings, patterns and/or marks can be printed on a recording sheet by pressing ink through the pores of the stencil sheet, onto the recording sheet.

A stencil stamp assembly comprising, as principal components, the aforesaid thermal stencil sheet and an ink-bearing member impregnated with ink is disclosed in Japanese Utility Model Laid-open publication No. Hei 5-74833. This previously proposed stencil stamp assembly is capable of replacing conventional stamps provided with a rubber stamping member.

This stencil stamp assembly is fabricated by adhesively attaching an ink-bearing member impregnated with ink to a frame surrounding the ink-bearing member, and adhesively attaching a thermal stencil sheet to the frame.

When using the stencil stamp assembly on a stamping device, the stencil stamp assembly is adhesively attached to a cushion member on a lower surface of a base of the stamping device. The stamping device is provided with a handgrip. Character strings or the like are formed in a desired pattern in the thermal stencil sheet with infrared beams or a thermal head. The resulting stamping device is capable of printing many copies of the desired pattern or character strings on a recording sheet.

A stamping device comprising a stamping unit, and a thermal pore forming unit for forming pores in a stamping member of the stamping unit, is disclosed in Japanese Patent Laid-open Publication No. Hei 4-226778. The stamping unit comprises a handgrip, a case, a feed reel for feeding a roll of thermal stencil tape supported on the case, a take-up reel for taking up the thermal stencil tape which is also supported on the case, and an ink-bearing member for applying ink to the thermal stencil tape. The thermal pore forming unit comprises a stamping unit holding mechanism for detachably holding the stamping unit, a feed mechanism for feeding the thermal stencil tape through the stamping unit, a thermal head for forming pores in the thermal stencil tape, a keyboard for entering characters and symbols, and a controller for controlling the feed mechanism and the thermal head so that pores are formed in the thermal stencil tape in a pattern represented by the input data.

In this stamping device, pores can be formed in the thermal stencil tape in any desired pattern because the stamping unit includes a supply of blank thermal stencil tape, and the thermal pore forming unit is capable of forming pores in the stamping member in a desired pattern input by the user. In addition, the stamping member need not be inked by an external inking device because ink is applied automatically to the stamping member by the ink-bearing member included in the stamping unit.

The ink-bearing member employed in the prior art stamp assemblies is formed of a foam material, such as a foam synthetic resin, in a single-layer structure. An ink-bearing member of this kind having a low foam density has a large ink absorption capacity. An ink-bearing member of this kind having a high foam density, conversely, has a small ink absorption capacity and a high ink holding ability, (ability to retain ink).

The aforesaid stamping unit, utilizing the thermal stencil, must compare favorably with a stamping unit utilizing a rubber stamping member in terms of print quality, stamping durability, facility of use and compactness. Accordingly, the ink-bearing member must have a large ink absorption capacity to provide high stamping durability (a large number of possible stamping cycles). Because the stamping unit has limited dimensions, the stamping unit is provided with an ink-bearing member having a large ink absorption capacity. Because an ink-bearing member having a large ink absorption capacity has a low density, however, the following problems may occur:

A. When pores are formed in the thermal stencil tape by pressing a thermal head against the stamping member, the thermal stencil tape is liable to be bent, and pores are formed incorrectly. This occurs because an ink-bearing member having a small foam density (large ink capacity) has a low mechanical resilience. Because the ink-bearing member is not physically firm, the thermal stencil tape is liable to be creased, thus adversely affecting print quality.

B. When the foam density of the ink-bearing member is low, the surface of the thermal stencil tape covering the surface of the ink-bearing member becomes irregular and rough, and the thermal head is unable to come into uniform contact with the thermal stencil tape. Consequently, the size of the pores formed by the thermal head are liable to vary widely, and the quantity of ink pressed out through the pores varies accordingly. As a result, print quality is deteriorated.

C. If the stencil stamping assembly is left unused for a long period of time with the ink-bearing member nearly saturated with ink, ink tends to leak through the pores of the stencil tape, thus contaminating the working environment. The leakage of ink results from the ink-bearing member having a low foam density.

After a certain quantity of ink has been consumed during stamping, the rate of supply of ink to the stamping plane decreases. Even when the ink-bearing member still contains a considerable quantity of ink, the ink is used inefficiently. As a result, the stencil stamping assembly must be replaced before all ink has been used, and the cost of using a stencil stamp is relatively high.

SUMMARY OF THE INVENTION

An object of the present invention is to provide a stencil stamping assembly having a miniaturized construction, high ink holding capacity, high stamping durability, and that is capable of high-quality stamping.

With the foregoing object in view, the present invention is directed to a stencil stamping assembly having a base member connectable to a handgrip, an ink-bearing member impregnated with ink and fixed to a lower surface of the base member, and a thermal stencil sheet covering a lower surface of the ink-bearing member and forming a stamping part. The ink-bearing member has a laminated structure comprising at least two layers, each layer having a different density. The layer having a higher density may be nearer to the thermal stencil sheet than the layer having a lower density.

Once pores are formed in a desired pattern in the thermal stencil sheet, the stamping part is pressed against the surface of a recording sheet. Ink held by the ink-bearing member is pressed out through the pores and onto the recording sheet to form the desired pattern on the recording sheet.

The layer of the ink-bearing member having a lower density is capable of holding a relatively large amount of ink to provide high stamping durability for the stencil stamp assembly. The layer having a higher density has a relatively high ink holding ability and is capable of preventing leakage of the ink. Furthermore, because ink is transferred continuously from the low density layer to the high density layer by capillary action, the high density layer will not run short of ink. In addition, because the high density layer is comparatively rigid, the high density layer withstands stamping pressure and is capable of preventing creasing and the bending of the thermal stencil sheet.

As is apparent from the foregoing description, a stencil stamp assembly embodying the present invention has a comparatively small size, and is provided with an ink-bearing member having a high ink holding capacity. In addition, because the lower portion of the ink-bearing member is relatively firm, the stamp assembly allows for highly accurate pore formation. Because pores can be formed with great accuracy, the stamp is capable of forming stamping patterns having high print quality. The stencil stamp also has excellent stamping durability. Because problems attributable to ink, such as ink leakage, can be solved by varying the characteristics of the ink-bearing member, the stamping unit may utilize an ink having a comparatively low viscosity, and various embodiments of the stencil stamp assembly can be created to satisfy unique user demands.

BRIEF DESCRIPTION OF THE DRAWINGS

Preferred embodiments of the present invention will be described in detail with reference to the following figures wherein.

DETAILED DESCRIPTION OF THE PREFERRED EMBODIMENT

Figure 1:
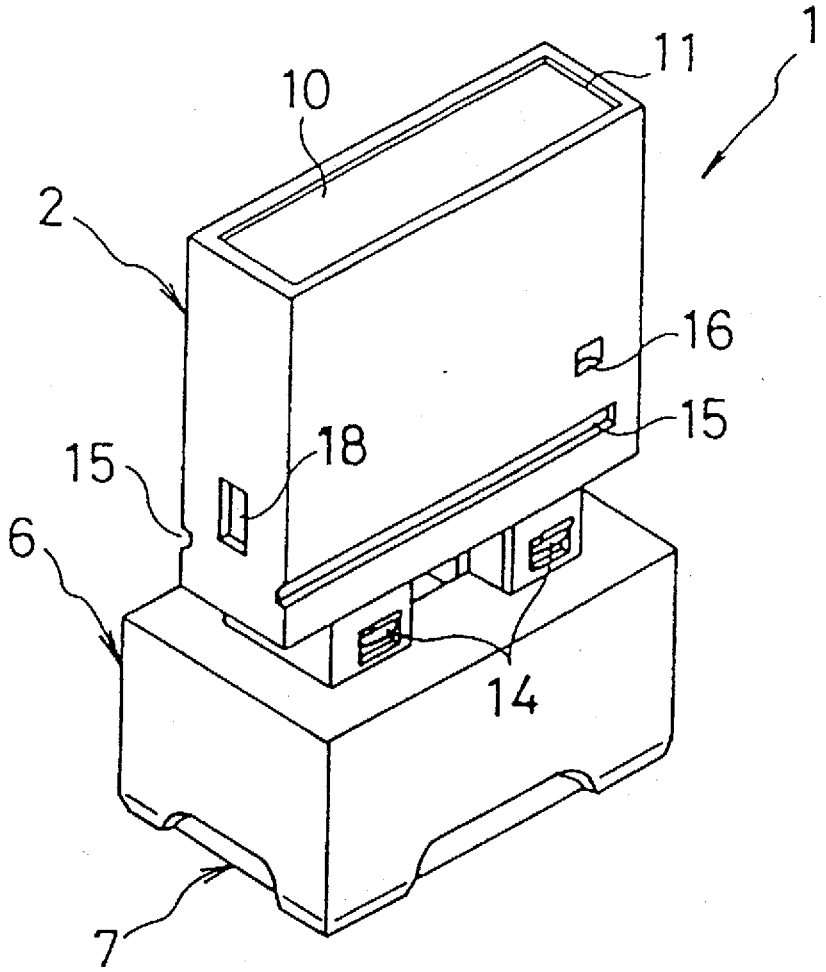
FIG. 1 is a perspective view of a stamping device embodying the present invention.

A preferred embodiment of the present invention will be described hereinafter with reference to the accompanying drawings.

Referring to FIGS. 1 to 4, a stamping device 1 provided with a stencil stamp assembly embodying the present invention comprises a handgrip 2 to be grasped by a user's hand, a stamping unit 3 fixedly connected to the handgrip 2, a skirt 6 surrounding the stamping unit 3, and a protective cap 7 detachably attached to the stamping unit 3.

The handgrip 2 is a hollow, rectangular parallelepipedic structure which may be formed of a metal or a synthetic resin, and which has an open lower end. A recess 11 is formed in the upper wall 19 of the handgrip 2, and a label 10 may be applied to the bottom surface of the recess 11. Two pairs of hooks 14 project downward from the lower ends of the front wall 12 and the back wall 13, respectively, of the handgrip 2. Guide grooves 15 are formed in the surfaces of the lower portions of the front wall 12 and the back wall 13, respectively. An engagement recess 16 is formed in the front wall 12, and an engagement hole 18 is formed in the left side wall 17. A spring support 20 is formed in the central portion of the lower surface of the upper wall 19 of the handgrip 2.

The stamping unit 3 comprises a stencil stamp assembly 4 and an outer holding member 5. The stencil stamp assembly 4 is inserted in the outer holding member 5 from below and is fixed in place within the outer holding member 5 so that approximately the top two-thirds of the stencil stamp assembly 4 is covered with the outer holding member 5. The four hooks 14 of the handgrip 2 engage with the outer holding member 5 to fixedly hold the outer holding member 5 to the handgrip 2.

The stencil stamp assembly 4 comprises a base member 26 having a hollow, rectangular shape that may be formed of a synthetic resin. The base member 26 has a shallow recess 25 in its bottom surface. An ink-bearing member 27, impregnated with ink, is fitted in the recess 25. A thermal stencil sheet 28 covers the lower surface of the ink-bearing member 27 and the outer circumference of the base member 26. The thermal stencil sheet 28 may be adhesively attached to the outer circumference of the base member 26 with an adhesive 29. The ink-bearing member 27 may be attached to the bottom surface of the recess 25 of the base member 26 with an adhesive or the like.

Because the base member 26 is wetted with ink, the base member 26 may be formed of a metal or a synthetic resin having an excellent resistance to the ink, such as vinyl chloride, polypropylene, polyethylene, polyacetal, or polyethylene terephthalate. The recess 25 of the base member 26 containing the ink-bearing member 27 prevents the dislocation of the ink-bearing member 27 and the effluence of the ink from the top and sides of ink-bearing member 27.

The ink-bearing member 27 has a layered structure including at least two layers having different densities. Each layer may be formed of an elastic foam synthetic resin, such as polyethylene, polypropylene, polyethylene terephthalate, polyurethane or acrylonitrile-butadiene rubber, or the layers may be formed of a non-woven fabric. The ink-bearing member 27 is placed in the recess 25 with a first ink-bearing layer 27A, having a higher density, adjacent the thermal stencil sheet 28. A second ink-bearing layer 27B, having a lower density, is located adjacent the lower surface of the base member 26. The respective densities of the first ink-bearing layer 27A and the second ink-bearing layer 27B are varied depending on the properties of the ink. For example, a density suitable for the first ink-bearing layer 27A may be in the range of 100 to 800 $kg/m_3$ for most common inks, and a density suitable for the second ink-bearing layer 27B may be in the range of 40 to 240 $kg/m^3$ for most common inks. The density of the first ink-bearing layer 27A should be higher than that of the second ink-bearing layer 27B.

The ink-bearing member 27 is saturated with ink. When pressure is applied to the ink-bearing member 27, ink is squeezed out. The first ink-bearing layer 27A and the second ink-bearing layer 27B may be partially connected with an adhesive or the like, they may be joined together by welding, or they may be provided with irregularities in their contact surfaces to help prevent the dislocation of the first ink-bearing layer relative to the second ink-bearing layer. Alternately, they may be simply placed adjacent one another instead of being adhesively connected.

Figure 6:
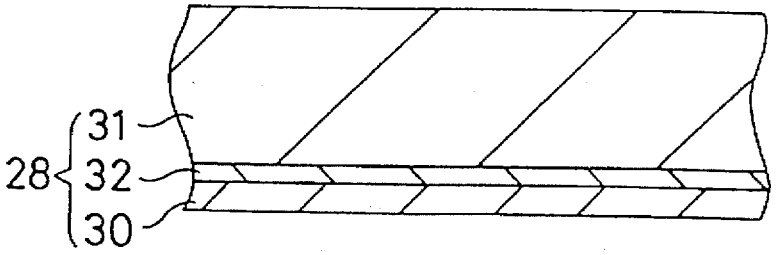
FIG. 6 is an enlarged sectional view of a thermal stencil sheet of a stamping device embodying the present invention.

As shown in FIG. 6, the thermal stencil sheet 28 comprises a thermoplastic film 30, a porous foundation 31 and an adhesive layer 32 connecting the thermoplastic film 30 to the porous foundation 31. The thermoplastic film 30 is a film of a thermoplastic synthetic resin, such as polyethylene terephthalate, polypropylene, a copolymer of vinylidene chloride and vinyl chloride or the like. In preferred embodiments, the thermoplastic film 30 may have a thickness in the range of approximately 1 to 4 μm, preferably, a thickness of 2 μm.

Thermoplastic films having a thickness less than 1 μm are costly, have a comparatively low strength, and hence are not practical. Thermoplastic films of a thickness greater than 4 μm are excessively thick, and it is difficult to form pores therein with an ordinary thermal head having a rated output capacity in the range of 50 to 300 $mJ/mm^2$.

The porous foundation 31 may be comprised of a tissue paper of a textile material containing, as a principal material, a natural fiber such as Manila hemp fiber, paper mulberry fiber or mitsumata plant fiber, a synthetic fiber such as polyethylene terephthalate fiber, polyvinyl alcohol fiber or polyacrylonitrile fiber, or a semi-synthetic fiber such as rayon fiber.

Figure 7:
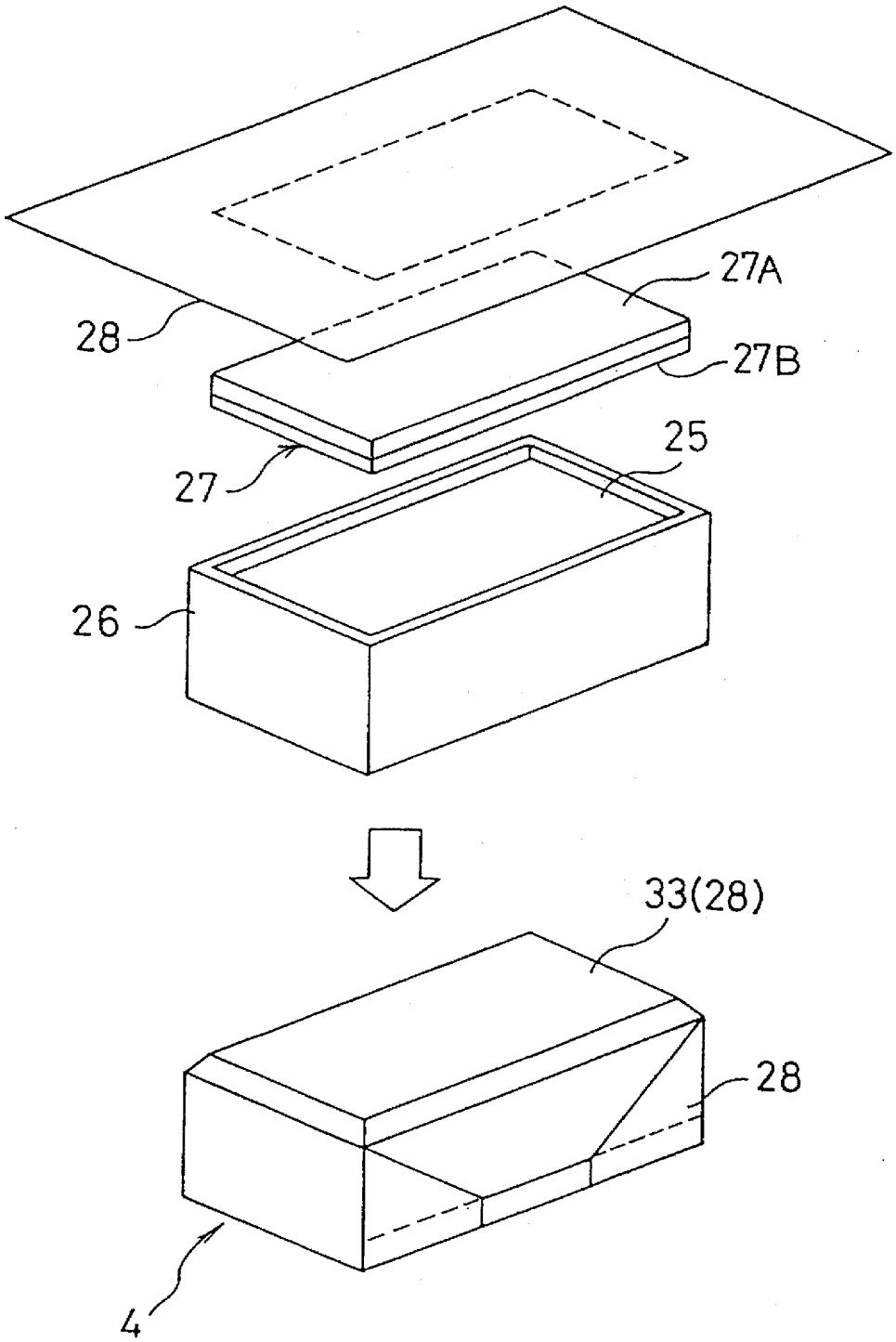
FIG. 7 is an exploded perspective view of a stencil stamp assembly.

The stencil stamp assembly 4 may be assembled as shown in FIG. 7. The base member 26 is set in an inverted position, the ink-bearing member 27 is placed in the recess 25, the ink-bearing member 27 is impregnated with ink, and the thermal stencil sheet 28 is put over the base member 26 with the porous foundation 31 thereof in close contact with the ink-bearing member 27. The periphery of the thermal stencil sheet 28 is folded so as to be in close contact with the side surfaces of the base member 26, and the periphery of the thermal stencil sheet 28 is adhesively attached to the base member 26 with an adhesive layer 29 to complete the stencil stamp assembly 4.

The portion of the thermal stencil sheet 28 in close contact with the ink-bearing member 27 comprises a stamping part 33. Since the periphery of the thermal stencil sheet 28 is adhesively attached to the side surfaces of the base member 26, as mentioned above, the stamping part 33 extends over substantially the entire lower surface of the stamping unit 3, which simplifies positioning for stamping.

The adhesive layer 29 for adhesively attaching the periphery of the thermal stencil sheet 28 to the side surfaces of the base member 26 may be formed beforehand on the periphery of the thermal stencil sheet 28, or the adhesive layer 29 may be formed on both the periphery of the thermal stencil sheet 28 and the side surface of the base member 26.

Figure 2:
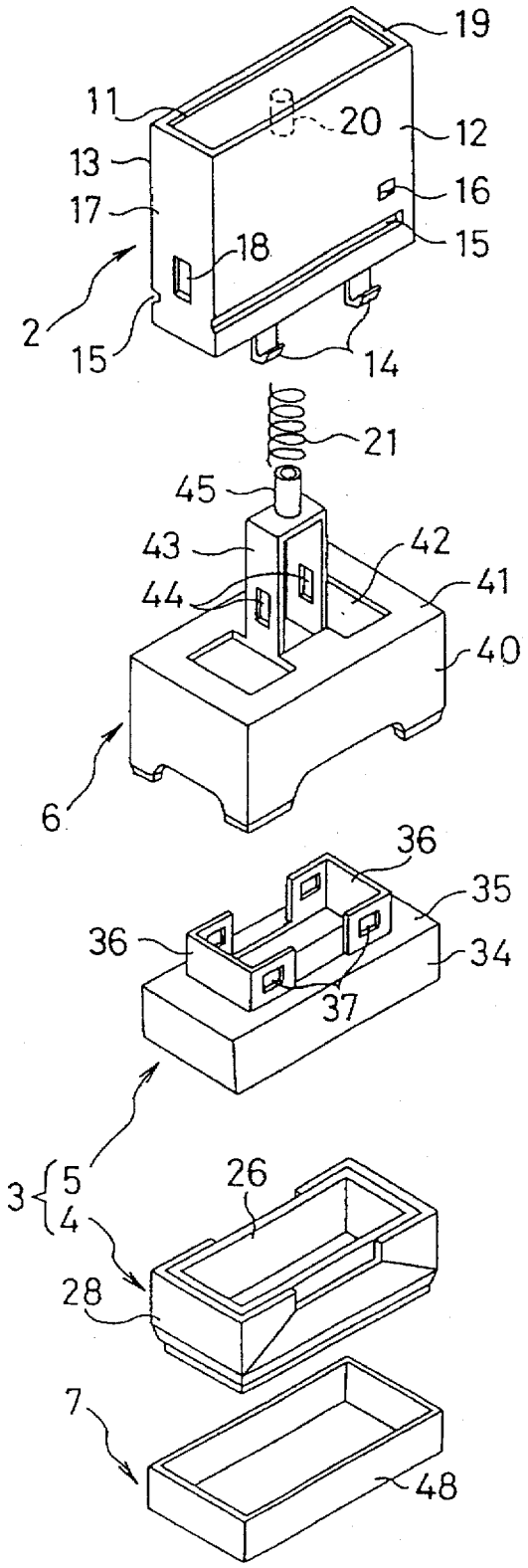
FIG. 2 is an exploded perspective view of the stamping device of FIG. 1.
Figure 3:
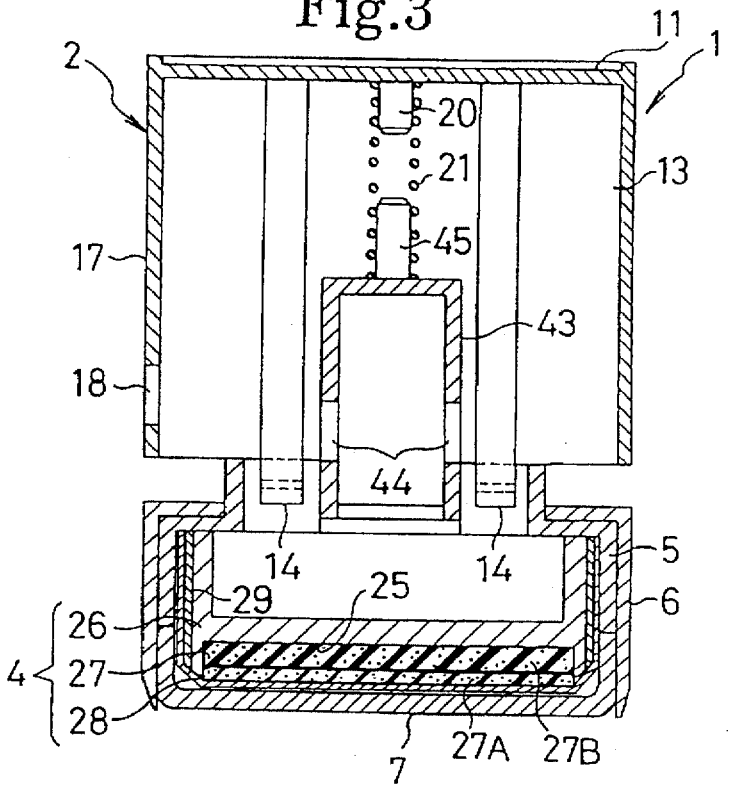
FIG. 3 is a longitudinal sectional front view of the stamping device of FIG. 1.
Figure 4:
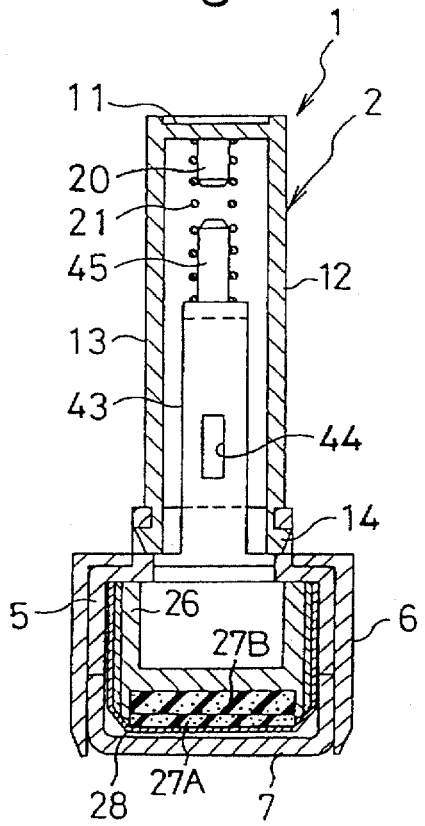
FIG. 4 is a longitudinal sectional side view of the stamping device of FIG. 1.
Figure 5:
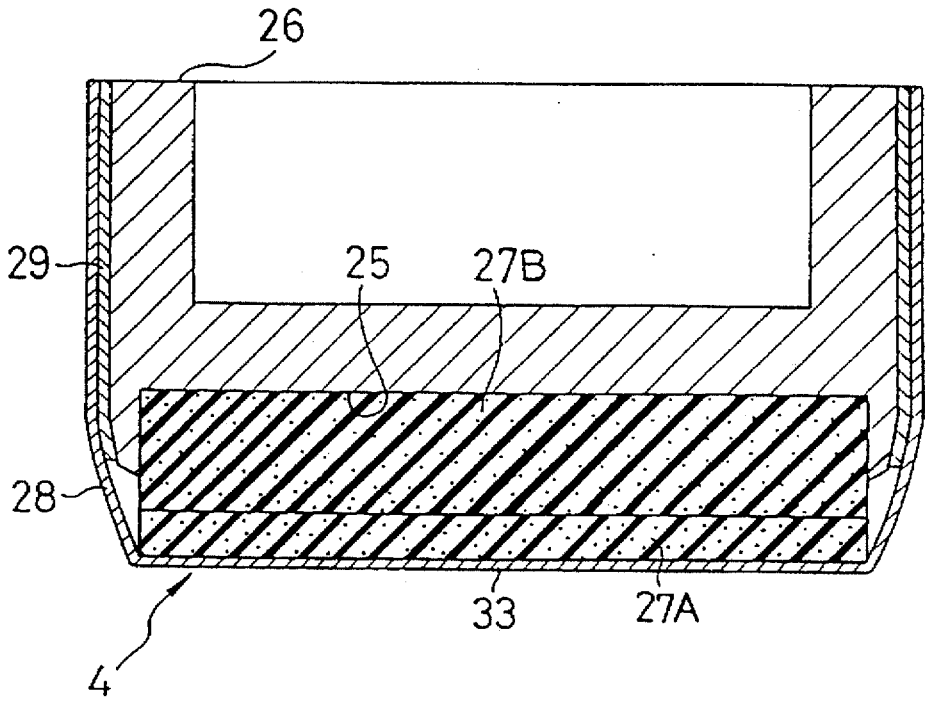
FIG. 5 is an enlarged longitudinal sectional front view of a portion of a stencil stamp assembly embodying the present invention.

Referring to FIGS. 2 to 4, the outer holding member 5 has side walls 34 having the shape of a rectangular frame in which the stencil stamp assembly 4 is placed, and to which the stencil stamp assembly 4 is adhesively attached. A pair of engagement walls 36 of a predetermined height are formed on an upper wall 35. The pair of engagement walls 36 are provided with engagement holes 37. The pair of engagement walls 36 are inserted through a pair of rectangular holes 42 formed in the upper wall 41 of the skirt 6 from below the skirt 6. The four hooks 14 engage the four engagement holes 37 of the engagement walls 36 to connect the outer holding member 5 fixedly to the handgrip 2.

As shown in FIGS. 2 to 4, the skirt 6 has side walls 40 having the shape of a rectangular frame for receiving the side walls 34 of the outer holding member 5. The skirt 6 also has an upper wall 41 extending over the upper wall 35 of the outer holding member 5. A U-shaped stem 43 of a predetermined height projects upward from the central portion of the upper wall 41 into the handgrip 2. A spring support 45 projects from the central portion of the upper end of the stem 43. Guide holes 44 are formed in the lower portions of the legs of the stem 43 at positions corresponding to the guide hole 18 in the handgrip 2.

Figure 8:
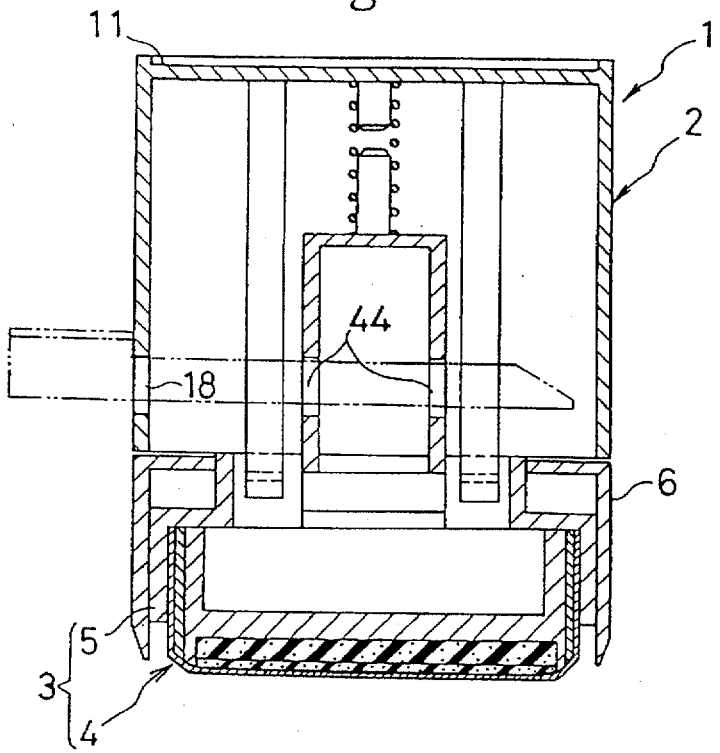
FIG. 8 is a longitudinal sectional front view of a stamping device embodying the present invention and having a skirt.
Figure 9:
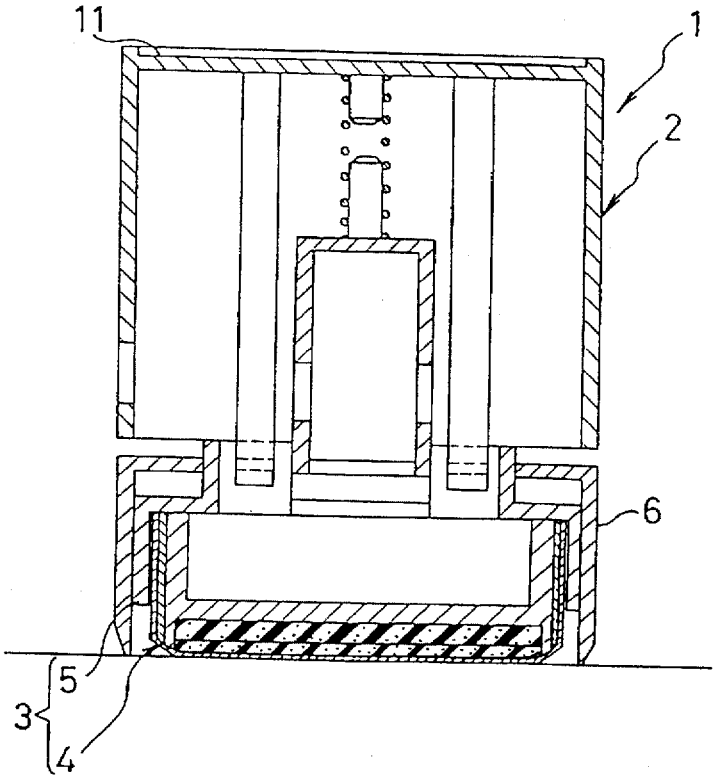
FIG. 9 is a longitudinal sectional front view of a stamping device embodying the present invention and having a skirt.

A compression spring 21 extends between the spring support 20 of the handgrip 2 and the spring support 45 of the skirt 6 so as to bias the skirt 6 downward and away from the handgrip 2. The skirt 6 is vertically movable between a first position, as shown in FIGS. 3 and 4, a second position, as shown in FIG. 9, and a third position, as shown in FIG. 8. The skirt 6 is biased toward the first position by the compression spring 21. Recesses are formed in the middle portions of the lower edges of the side walls 40 of the skirt 6, to facilitate attachment and detachment of the protective cap 7 and to facilitate positioning of the stamping part 33 on the recording sheet.

When the skirt 6 is at the first position, the upper wall 41 of the skirt 6 is in contact with the upper wall 35 of the outer holding member 5, and the lower ends of the side walls 40 of the skirt 6 are positioned below the stamping part 33. When the skirt 6 is at the second position, the upper wall 41 of the skirt 6 is located between the upper wall 35 of the outer holding member 5 and the lower end of the handgrip 2, and the lower ends of the side walls 40 of the skirt 6 are flush with the stamping part 33. When the skirt 6 is at the third position, the upper wall 41 of the skirt 6 is in contact with the lower end of the handgrip 2, and the lower ends of the side walls 40 of the skirt 6 are above the stamping part 33. In a preferred embodiment, the stroke of the skirt 6, i.e., the distance between the first position and the second position, is about 5 mm.

The protective cap 7 is detachably put on the stencil stamp assembly 4 to cover the lower end of the stencil stamp assembly 4 for protection. The shape of the side walls 48 of the protective cap 7 are the same as that of the side walls 34 of the outer holding member 5, as shown in FIGS. 3 and 4. The protective cap 7 fits snugly inside the side walls 40 of the skirt 6. As shown in FIGS. 3 and 4, when the protective cap 7 is fitted inside the side walls 40 of the skirt 6, the upper ends of the side walls 48 of the protective cap 7 are in contact with the lower ends of the side walls 34, and a small clearance exists between the protective cap 7 and the stamping part 33. The protective cap 7 is held in place by the friction between the side walls 48 thereof, and the side walls 40 of the skirt 6. Because of the clearance between the protective cap 7 and the stamping part 33, the protective cap 7 will not be stained with ink, even if the handgrip 2 is depressed while the protective cap 7 inserted in the skirt 6. The clearance is always maintained because the upper ends of the protective cap 7 are in contact with the lower ends of the side walls 34.

Figure 10:
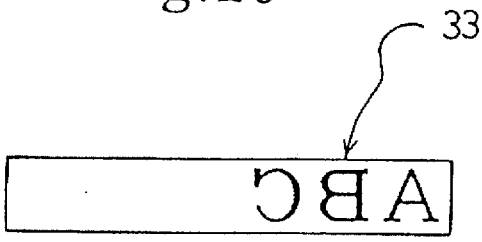
FIG. 10 is an illustration of a pattern formed by pores in the stamping part of a stencil sheet.
Figure 11:
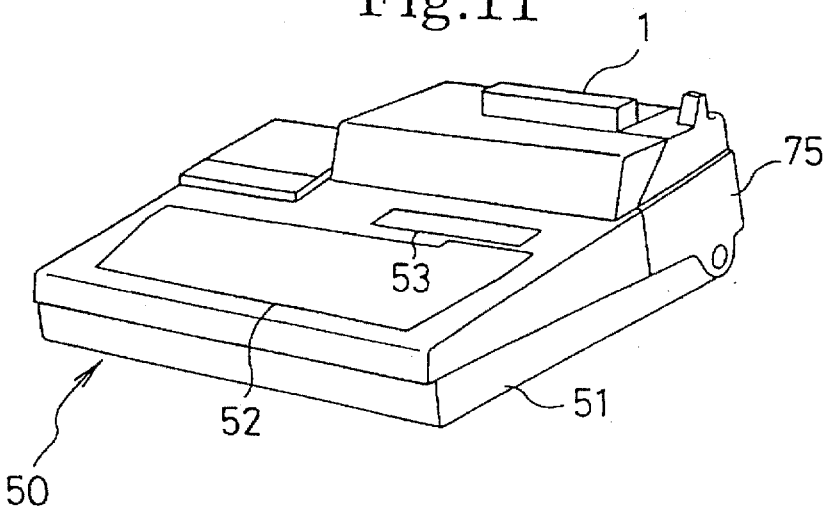
FIG. 11 is a perspective view of a thermal pore forming device.
Figure 12:
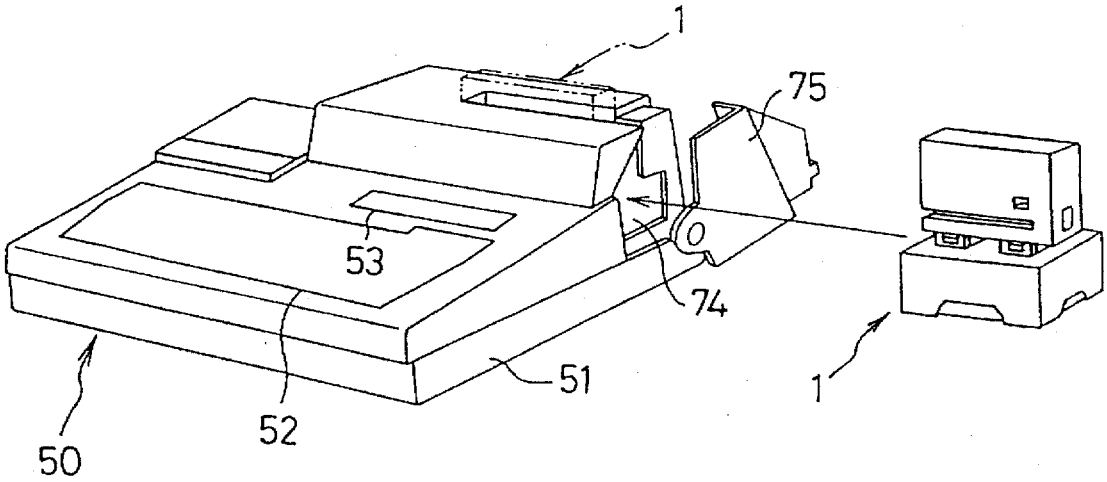
FIG. 12 is a perspective view of a thermal pore forming device and a stencil stamp.
Figure 13:
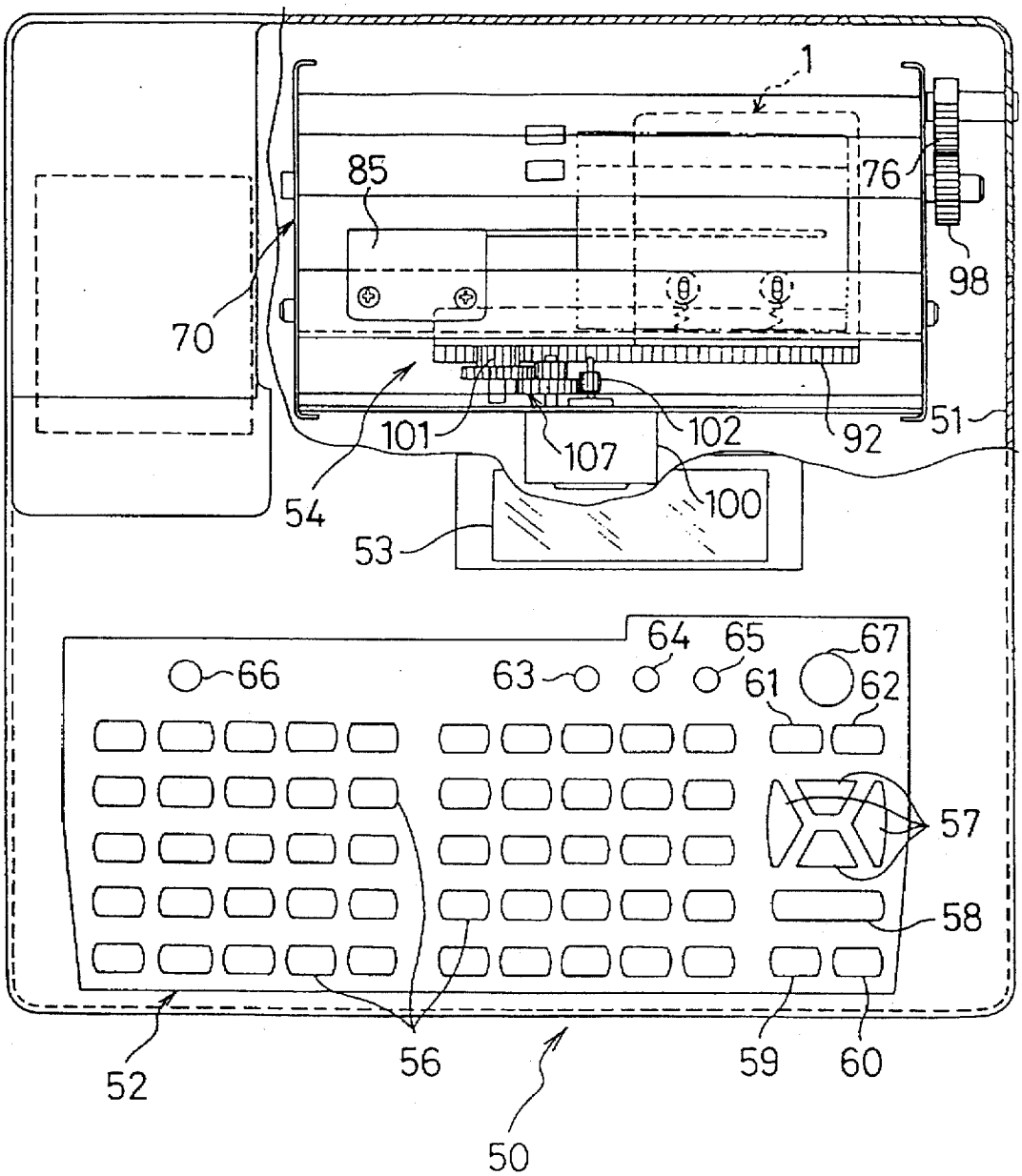
FIG. 13 is a partial cutaway plan view of a thermal pore forming device.

As shown in FIG. 10, pores (holes) are formed in a pattern of a character string, such as "ABC," on the stamping part 33 of a thermal stencil sheet. The characters are actually a mirror image of the image that is to be reproduced on the recording sheet. The pores may be formed by a thermal head of a thermal printer, not shown. The stamping part 33, similarly to an ordinary stamping device provided with a rubber stamping member, is able to stamp the mirror image of the patterns, for example, 1000 times. Naturally, infrared beams may be used instead of the thermal head for forming the pores in the stamping part 33.

When forming pores in the stamping part 33 of the thermal stencil sheet 28, the stamping device 1 may be placed in a stamping device holding unit 71 of a thermal pore forming device 50 (which will be described later). The holding device includes a guide bar 83 that is inserted through the guide holes 18 and 44 to hold the skirt 6 at the third position during the pore forming operation. When the stamping device is not in use, the protective cap 7 is put on the stamping device 1 and the skirt 6 is held at the first position, as shown in FIGS. 3 and 4 by the biasing action of the spring 21. When using the stamping device 1, the protective cap is removed, the skirt 6 being held at the first position by the spring 21. The skirt 6 is used to position the stamping part 33 of the stamping device over the appropriate position of a recording sheet. The hand grip 2 is then depressed for stamping, as shown in FIG. 9.

A thermal pore forming device 50 for forming pores in the stamping part 33 of the thermal stencil sheet 28 of the stamping device 1 will be described hereinafter with reference to FIGS. 11–16.

The thermal pore forming device 50 comprises a main frame 51, a keyboard 52 disposed in the front portion of the main frame 51, a display screen 53 disposed in the front portion of the main frame 51, a thermal pore forming unit 54 disposed in the rear portion of the main frame 51, a printing unit disposed contiguously with the thermal pore forming unit 54, and a control unit disposed within the main frame 51.

In a preferred embodiment, the keyboard 52 is provided with a plurality of keys 56 including a plurality of character keys, a plurality of symbol keys, a plurality function keys including cursor move keys 57, an enter key 58, a return key 59, a determination/end key 60, a cancel key 61, a delete key 62, a shift key 63, a lower case switch 64, a character type setting switch 65, a pore forming start switch 66, and a main switch 67.

The display screen 53 is capable of displaying character strings to be stamped by a stamping device 1 in a plurality of lines.

Figure 14:
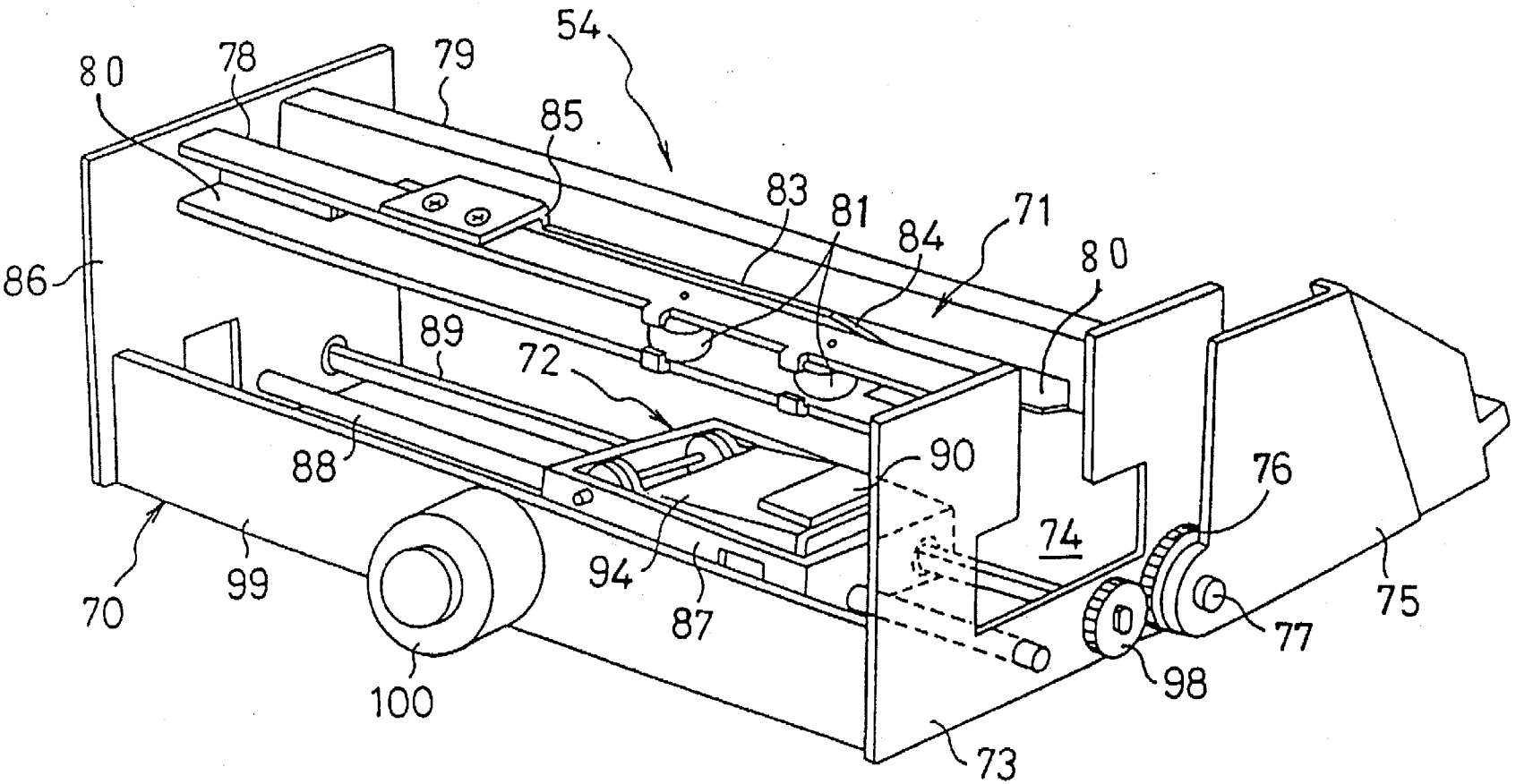
FIG. 14 is a perspective view of a thermal pore forming unit of a thermal pore forming device.

Referring to FIGS. 13 to 16, the thermal pore forming unit 54 has a subframe 70, the stamping device holding unit 71, and a thermal pore forming mechanism 72 for forming pores (holes) in the stamping part 33 of a stamping device 1 held in the stamping device holding unit 71. As shown in FIG. 14, an opening 74 having a shape similar to the side of the lower half of the stamping device 1 is formed in the right wall 73 of the subframe 70. A sector gear 76 is fixed to a lid 75 for covering the opening 74, and the lid 75 and the sector gear 76 are supported pivotally on the right wall 73 by a shaft 77 extending transversely as viewed in FIG. 14. A pair of guide members 78 and 79 extend parallel to each other in the upper portion of the subframe 70. The guide members 78 and 79 have opposite, transverse, horizontal, parallel guide portions 80 at the lower edges thereof, respectively.

Figure 16:
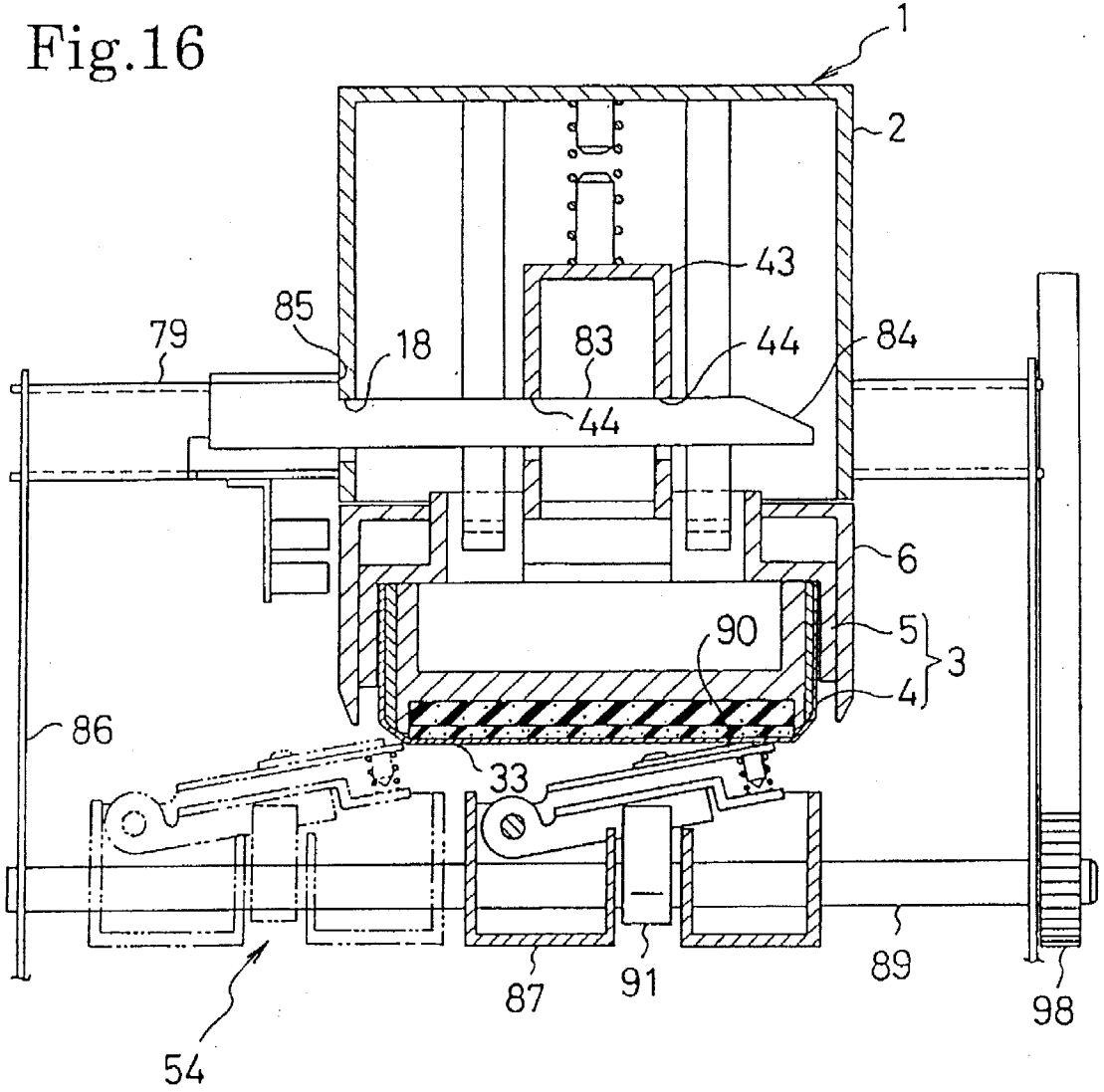
FIG. 16 is a longitudinal sectional front view of a stamping device loaded into a thermal pore forming unit.

A guide bar 83 fixed to the guide member 78 extends in a space between the guide members 78 and 79. As shown in FIGS. 14 and 16, a sloped portion 84 is formed in the upper surface of the right end of the guide bar 83. A stopper 85 for stopping the stamping device at a leftmost position is formed at the left end of the guide bar 83. When loading the stamping device 1 into the stamping device holding unit 71, the guide bar 83 extends through the guide holes 18 and 44 of the stamping device 1 to hold the skirt 6 at the third position (FIG. 8).

Referring to FIGS. 13 to 16, the thermal pore forming mechanism 72 is disposed under the stamping device holding unit 71. A guide rod 88 for guiding a carriage 87, and a head shifting rod 89 for guiding the carriage 87 and operating a cam 91 for changing the position of a thermal head 90 mounted on the carriage 87 extend transversely between the right wall 73 and the left wall 86 of the subframe 70. The cam 91 is axially slidably mounted on the head shifting rod 89 and is restrained from freely rotating around the head shifting rod 89.

The carriage 87 is supported on the guide rod 88 and the head shifting rod 89 for transverse movement. A rack 92 of a length corresponding to the length of the carriage 87 is formed in the front end of the carriage 87.

A cam-driven plate 93 and a heat radiating plate 94 for the thermal head 90 are supported for rotation about a longitudinal shaft 95. The thermal head 90 is fixed to the heat radiating plate 94, and the heat radiating plate 94 is elastically biased upward relative to the cam-driven plate 93 by a spring 97 positioned on a pin 96 fixed to the heat radiating plate 94.

Figure 15:
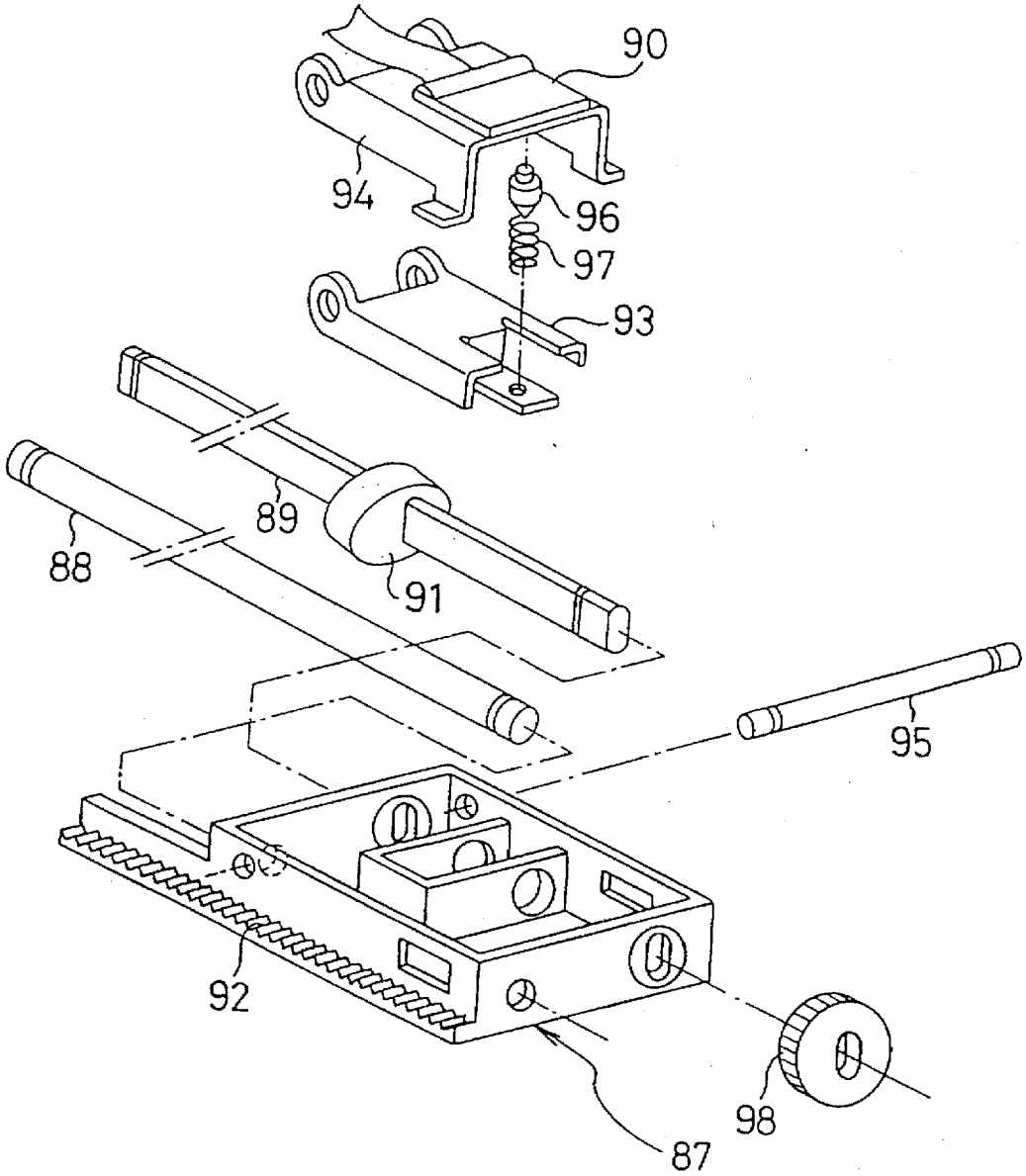
FIG. 15 is an exploded perspective view of a portion of a thermal pore forming mechanism.

The cam 91 has an elliptic shape and is in contact with the lower surface of the cam-driven plate 93. When the head shifting rod 89 is rotated to set the cam 91 in a horizontal position, as shown in FIG. 15, the thermal head 90 is lowered with the heat radiating plate 94, and retracted from a pore forming position. When the head shifting rod 89 rotates and sets the cam 91 in a vertical position, the thermal head 90 is pushed upward via the cam-driven plate 93 and the spring 97 to a pore forming position.

A pinion 98 is mounted on the right end of the head shifting rod 89 that projects from the right wall 73 of the subframe 70, and is engaged with the sector gear 76. The head shifting rod 89 is rotated to set the cam 91 in the horizontal position (head retracted) when the lid 75 is opened, and the head shifting rod 89 is rotated to set the cam 91 in the vertical position (head engaged) when the lid 75 is closed.

Mounted on the front wall 99 of the subframe 70 are a stepping motor 100 for driving the carriage 87, a driving gear 101 engaged with the rack 92, and a reduction gear 107 for transmitting the rotation of an output gear 102 (mounted on the output shaft of the stepping motor 100) to the driving gear 101. Therefore, the rotational output speed of the stepping motor 100 is reduced, and the rotative driving force of the stepping motor 100 is transmitted to the driving gear 101 to drive the carriage 87 for transverse movement.

The thermal head 90, which is similar to the thermal print head of a thermal printer, is provided with, for example, ninety-six heating elements arranged in a single longitudinal row. In a pore forming process, the stamping device 1 is mounted on the stamping device holding unit 71, the thermal head 90 is brought into contact with the stamping part 33 of the stamping device 1, and then the heating elements of the thermal head 90 are selectively driven while the thermal head 90 is moved together with the carriage 87.

To use a stamping device embodying the invention, the protective cap 7 is removed, and the stamping part 33 is positioned at a desired position over the surface of a recording sheet using the skirt 6 as a positioning means. The handgrip 2 is depressed to press the stamping part 33 against the surface of the recording sheet. Ink contained in the first ink-bearing layer 27A of the ink-bearing member 27 is squeezed out through the pores in the stamping part 33 and onto the surface of the recording sheet to deposit ink dots on the recording sheet in the desired pattern.

The ink-bearing member 27 is a two-layer structure comprised of the two ink-bearing layers 27A and 27B, which have different densities. Because the second ink-bearing layer 27B has a lower density, it is capable of holding a large quantity of ink. The large ink holding capacity of the second ink-bearing layer 27B allows a stamping device 1 of a comparatively small size to have a high stamping durability. Although the second ink-bearing layer 27B has a relatively low ink holding ability, the ink will not leak because the first ink-bearing layer 27A, underlying the second ink-bearing layer 27B, intercepts the downward travel of ink. Accordingly, ink having a viscosity lower than that of ordinary ink can be used.

Because the ink impregnated in the second ink-bearing layer 27B is transferred to the first ink-bearing layer 27A by capillary action, an appropriate quantity of ink is always held in the first ink-bearing layer 27A, even during repeated stamping. Accordingly, faint patterns are rarely formed on a recording sheet, even during repeated stamping. In addition, ink is used efficiently because the first ink-bearing layer 27A absorbs almost all the ink from the second ink-bearing layer 27B. As a result, the stamping device 1 can be physically small and inexpensive to operate.

Because the first ink-bearing layer 27A is contiguous with the stamping part 33, the surface of the stamping part 33 is smooth, fine-grained, firm and rigid. Accordingly, the stamping part 33 will not be creased by the stamping force, ink is squeezed out uniformly through the stamping part 33, and high quality patterns can be formed. Similarly, the stamping part 33 will not be significantly creased, and the thermal stencil sheet 28 will not be dislocated, when the thermal head is pressed against the stamping part 33 during the pore forming process. As a result pores will be uniformly formed in the stamping part 33.

When stamping a pattern on a recording sheet, the stamping part 33 is located over the recording sheet by positioning the skirt 6 at a correct stamping position on the surface of the recording sheet, then the handgrip 2 is depressed. Consequently, the spring 21 is compressed, the skirt 6 is moved to the second position, and the pattern can be stamped accurately at a desired position on the recording sheet. When the pressure applied to the handgrip 2 for stamping is removed, the skirt 6 returns to the first position, separating the stamping part 33 from the recording sheet, so that the pattern can be clearly stamped on the sheet even if the sheet is a very thin one. When stamping a pattern in a narrow frame on a recording sheet, the pattern can be stamped with the skirt 6 held at the second position or the third position by the operator's hand.

When the stamping device 1 is not in use, the skirt 6 is held at the first position by the spring 21, and the stamping device 1 is supported on the skirt 6 to protect the printing part 33.

Because the stamping unit 3 is provided with a thermal stencil sheet 28 that covers the entire lower surface of the ink-bearing member 27, and the outer holding member 5 surrounds the periphery of the thermal stencil sheet 28 on the side surfaces of the base member 26, the periphery of the thermal stencil sheet 28 surrounding the side surfaces of the base member 26 will not be damaged by the skirt 6, and the effluence of ink from the ink-bearing member 27 can be prevented. Furthermore, the protective cap 7 for covering the stamping part 33 of the stamping unit 3 can be used to protect the stamping part 33 from damage and dust when the stamping device is not in use, and accidental stamping can be prevented.

Because the skirt 6 is held at the uppermost position, i.e., the third position, by the guide bar 83 when the stamping device 1 is loaded into the stamping device holding unit 71 of the thermal pore forming device 50, the skirt 6 does not interfere with the pore forming operation.

Figure 17:
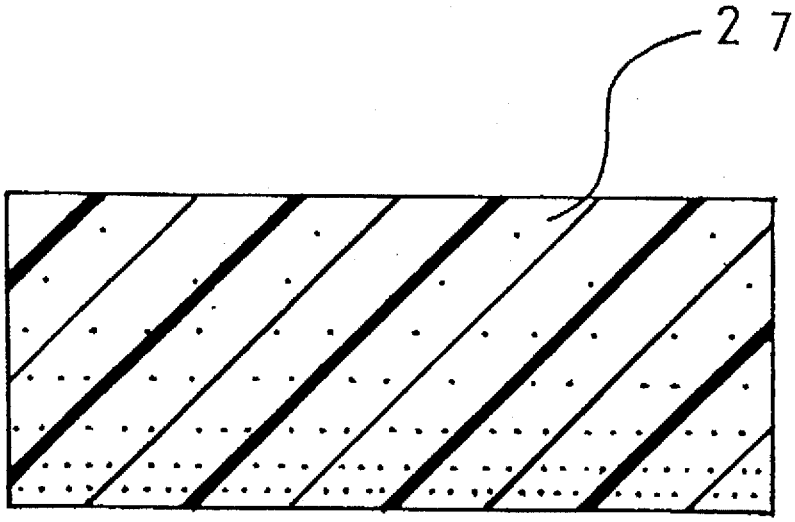
FIG. 17 is a sectional view of an ink-bearing member having a continuously varying density.

The following modifications may be made to the foregoing embodiment to create alternative preferred embodiments of the present invention:

1) Pores can be formed in the stamping part 33 of the thermal stencil sheet 28 in patterns other than those shown previously by way of example, and the patterns can be stamped on a recording sheet.
2) The heights of the handgrip 2 and the stamping unit 3 may be reduced, and the handgrip 2 and the stencil stamp assembly 4 may be united. Furthermore, the skirt 6 may be moved vertically relative to the stencil stamp assembly 4.
3) The handgrip 2 may be extended transversely of the stencil stamp assembly 4, instead of being extended upwardly of the stencil stamp assembly 4.
4) When the stamping part 33 is rectangular, the necessary functions of the skirt 6 can be achieved when the skirt 6 is provided with legs at least at its four corners.
5) The shape of the stamping part 33 of the stamping device 1 is not limited to a rectangular shape; the stamping part may have an elliptic shape, a circular shape, a square shape, a triangular shape, a polygonal shape or any kind of shape.
6) The color of the ink impregnated into the ink-bearing member 27 may be blue, black, red or any color. The color of the ink impregnated into the ink-bearing member 27 may be indicated by applying a piece of paper stamped by the stamping device to the bottom surface 10 of the recess 11.
7) The structure of the ink-bearing member 27 need not limited to a two-layer structure. The ink-bearing member 27 may be a three-layer structure, a four-layer structure, or may be a structure having more than four layers. Normally, the layers are stacked so that the layers having a greater density are nearer to the stamping part 33 when the ink-bearing member. In view of the leakage of ink, and the rigidity of the stamping part 33, it is preferable that at least the layer near the stamping part 33 has a high density. In addition, as shown in FIG. 17, the ink-bearing member 27 may be a single pad of a foam synthetic resin having a density that continuously varies along its thickness, instead of a multi-layer laminated pad.

What is claimed is:

1. A stencil stamp assembly, comprising:

a base member;

an ink-bearing member located on said base member and comprising at least two layers having different densities, said at least two layers of said ink-bearing member being impregnated with ink;

a thermal stencil sheet covering a surface of said ink-bearing member and forming a stamping part and a sealing part, wherein said sealing part of said thermal stencil sheet is adhered to outer side surfaces of said base member such that said sealing part sealingly encloses said ink-bearing member between said base member and said thermal stencil sheet; and a shirt member surrounding an outer peripheral side of said base member, said skirt member capable of substantially vertical movement with respect to said base member between a first position at which a lower end portion of said skirt member projects beyond said stamping part, a second position, at which said lower end portion of said skirt member is flush with said stamping part, and a third position, at which said lower end portion of said skirt member is above said stamping part, said vertical movement preventing inadvertent contact with said base member during an operation of said stencil stamp assembly.

2. The stencil stamp assembly according to claim 1, wherein said layers of said ink-bearing member are stacked, one on top of the other, a first layer is located closer to said thermal stencil sheet than a second layer, and wherein said first layer has a higher density than said second layer.

3. The stencil stamp assembly according to claim 2, wherein a thickness of said second layer is at least twice as large as a thickness of said first layer.

4. The stencil stamp assembly according to claim 2, wherein said first layer has a density between 100 and 800 $kg/m^3$.

5. The stencil stamp assembly according to claim 2, wherein said second layer has a density between 40 and 240 $kg/m^3$.

6. The stencil stamp assembly according to claim 1, wherein said layers of said ink-bearing member are selected from a group consisting of an elastic foam synthetic resin and a non-woven fabric.

7. The stencil stamp assembly according to claim 1, wherein said layers of said ink-bearing member are formed of the same material.

8. The stencil stamp assembly according to claim 1, wherein adjoining surfaces of said layers of said ink-bearing member have irregularities, and wherein said irregularities prevent said layers from shifting relative to one another.

9. The stencil stamp assembly according to claim 1, wherein said layers of said ink-bearing member are joined together by welds.

10. The stencil stamp assembly according to claim 1, further comprising a handgrip, wherein said base member is connected to said handgrip of the stencil stamp assembly.

11. The stencil stamp assembly according to claim 1, wherein said layers of said ink-bearing member are stacked, one on top of the other, a first layer has a higher density than a second layer, and wherein a thickness of said second layer is larger than a thickness of said first layer.

12. The stencil stamp assembly according to claim 1, wherein said layers of said ink-bearing member are stacked, one on top of the other, and wherein a layer having the highest density is located adjacent said thermal stencil sheet.

13. The stencil stamp assembly according to claim 2, wherein said ink bearing member comprises more than two layers, and the layer having the lowest density is located furthest from said thermal stencil sheet.

14. A stamp assembly, comprising:

a handgrip;

a base member connectable to said handgrip;

an ink-bearing member impregnated with ink and located on said base member, said ink-bearing member comprising at least two layers having different densities;

a thermal stencil sheet stationarily covering a surface of said ink-bearing member and having a stamping part and a sealing part, wherein said sealing part of said thermal stencil sheet is adhered to outer side surfaces of said base member such that said sealing part sealingly encloses said ink-bearing member between said base member and said thermal stencil sheet;

a skirt member surrounding an outer peripheral side of said base member, said skirt member capable of substantially vertical movement with respect to said base member between a first position at which a lower end portion of said skirt member projects beyond said stamping part, a second position, at which said lower end portion of said skirt member is flush with said stamping part, and a third position, at which said lower end portion of said skirt member is above said stamping part, said vertical movement preventing inadvertent contact with said base member during an operation of said stencil stamp assembly; and a plurality of apertures being formed through said stamping part of said thermal stencil sheet after said thermal stencil sheet is adhered to said base member, the ink from the ink-bearing member being passable through said apertures.

15. The stamp assembly according to claim 14, wherein a first layer of said ink-bearing member is located closer to said thermal stencil sheet than a second layer, and wherein said first layer has a higher density than said second layer.

16. The stamp assembly according to claim 15, wherein said second layer has a thickness at least twice as large as a thickness of said first layer.

17. The stamp assembly according to claim 15, wherein said first layer has a density between 100 and 800 $kg/m^3$.

18. The stamp assembly according to claim 15, wherein said second layer has a density between 40 and 240 $kg/m^3$.

19. The stamp assembly according to claim 14, wherein said ink-bearing member is located in a recess formed in said base member, a portion of said ink-bearing member projects from said base member, and said stamping part of said thermal stencil sheet covers the projecting portion of said ink-bearing member.

20. The stamp assembly according to claim 14, wherein peripheral portions of said thermal stencil sheet are adhesively attached to said base member.

21. The stamp assembly according to claim 14, wherein said layers of said ink bearing member are stacked, one on top of the other, the highest density layer is located adjacent the thermal stencil sheet, and the layers are arranged so that the densities of the layers is lower the further away from the thermal stencil sheet the layer is located.

22. A stamp assembly, comprising:

a handgrip;

a base member connectable to said handgrip;

an ink-bearing member impregnated with ink and located on said base member, said ink-bearing member having a continuously varying density;

a thermal stencil sheet stationarily covering a surface of said ink-bearing member and having a stamping part and a sealing part, wherein said sealing part of said thermal stencil sheet is adhered to outer side surfaces of said base member to sealingly enclose said ink-bearing member between said base member and said thermal stencil sheet;

a skirt member surrounding an outer peripheral side of said base member, said skirt member capable of substantially vertical movement with respect to said base member between a first position at which a lower end portion of said skirt member projects beyond said stamping part, a second position, at which said lower end portion of said skirt member is flush with said stamping part, and a third position, at which said lower end portion of said skirt member is above the stamping part, said vertical movement preventing inadvertent contact with said base member during an operation of said stencil stamp assembly; and a plurality of apertures being formed through said stamping part of said thermal stencil sheet after said thermal stencil sheet is adhered to said base member to enclose said ink-bearing member, ink from the ink-bearing member being passable through said apertures.

23. A stamp assembly according to claim 22, wherein a surface of said ink-bearing member having the highest density is located adjacent said thermal stencil sheet.

24. A stamp assembly according to claim 23, wherein said ink-bearing member is comprised of an elastic foam synthetic resin.

* * * * *